US008250681B2

(12) United States Patent
Han

(10) Patent No.: US 8,250,681 B2
(45) Date of Patent: Aug. 28, 2012

(54) VARIABLE BUOYANCY SETTING FLAPPER

(75) Inventor: Joseph Han, Irvine, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 570 days.

(21) Appl. No.: 12/150,841

(22) Filed: May 1, 2008

(65) Prior Publication Data

US 2008/0271233 A1 Nov. 6, 2008

Related U.S. Application Data

(60) Provisional application No. 60/915,857, filed on May 3, 2007.

(51) Int. Cl.
*E03D 1/14* (2006.01)

(52) U.S. Cl. ..... 4/324; 4/387; 4/392; 4/404; 4/395

(58) Field of Classification Search ..... 4/387, 392, 4/404, 324, 395; 137/118.2, 137, 118.02
See application file for complete search history.

(56) References Cited

U.S. PATENT DOCUMENTS

| | | | | |
|---|---|---|---|---|
| 4,419,773 | A | 12/1983 | Sullivan | |
| 4,497,076 | A * | 2/1985 | Sullivan | 4/392 |
| 5,153,948 | A | 10/1992 | Smith et al. | |
| 5,390,375 | A * | 2/1995 | Fernstrum, Jr. | 4/404 |
| 5,966,749 | A * | 10/1999 | Goesling et al. | 4/392 |
| 6,173,457 | B1 | 1/2001 | Higgins | |

OTHER PUBLICATIONS

Notification of Transmittal of the International Search Authority, Written Opinion for International Application No. PCT/US2008/05668 dated Aug. 29, 2008, 9 pages.

* cited by examiner

*Primary Examiner* — Gregory Huson
*Assistant Examiner* — Lauren Heitzer
(74) *Attorney, Agent, or Firm* — Gordon & Rees LLP

(57) ABSTRACT

A flush valve is provided for discharging fluid from a tank. The flush valve includes a flapper. The flapper includes a frame portion and a hollow float portion rotatably connected to the frame portion. A relative rotational position between the frame portion and the float portion adjusts at least one opening formed between the frame portion and the float portion, and controls an amount of fluid discharged from the tank by variably adjusting buoyancy of the flapper.

21 Claims, 8 Drawing Sheets

VARIABLE BUOYANCY SETTING FLAPPER

RELATED APPLICATIONS

This application relates to, claims priority from, and incorporates herein by reference, as if fully set forth, U.S. Provisional Patent Application Ser. No. 60/915,857, filed on May 3, 2007 and entitled "VARIABLE BUOYANCY SETTING FLAPPER."

BACKGROUND OF THE INVENTION

1. Field of the Invention

The present invention relates generally to toilet flush valves and particularly to flappers for such toilet flush valves.

2. Description of Prior Art and Related Information

A toilet tank typically employs a flush valve that is levered open, which remains open until a predetermined amount of water flows from the tank into the toilet bowl through the flush valve. A fill valve provides water from a supply line to the toilet tank. The fill valve is open whenever the water level in the tank is below a predetermined level.

BRIEF SUMMARY OF THE INVENTION

One aspect of the invention provides a flush valve for discharging fluid from a tank. The flush valve includes a flapper. The flapper includes a frame portion and a hollow float portion rotatably connected to the frame portion. A relative rotational position between the frame portion and the float portion adjusts at least one opening formed between the frame portion and the float portion, and controls an amount of fluid discharged from the tank by variably adjusting buoyancy of the flapper.

In one embodiment of the invention, the frame portion and the float portion each include at least one corresponding slot portion. In another embodiment of the invention the frame portion includes extensions forming grooves between adjacent extensions, and the float portion includes a tab configured to fit within a groove to prevent movement between the frame portion and the float portion. In yet another embodiment of the invention the float portion includes at least one lower hole portion. In still another embodiment of the invention adjusting the float portion relative to the frame portion adjusts flush rate of the tank to correspond to different flush volume standards. In another embodiment of the invention the flush valve is configured to a standard size. In one embodiment of the invention the frame portion includes reference indicators corresponding to different flush volumes. In yet another embodiment of the invention, the buoyancy of the flapper is adjusted during assembly to a standard flush rate and remains non-adjustable thereafter.

Another aspect of the invention provides a variable buoyancy flapper. The flapper comprises a frame portion, the frame portion including a sealing portion, and a float portion rotatably coupled to the frame portion. Rotating the float portion adjusts at least one opening formed between the frame portion and the float portion to control buoyancy of the flapper In one embodiment of the invention, the frame portion includes at least one slot portion. In another embodiment of the invention the float portion includes at least one slot portion. In yet another embodiment of the invention the frame portion includes at least one corresponding slot portion to the slot portion of the float portion. In still another embodiment of the invention, the frame portion includes a plurality of extensions forming a plurality of grooves between adjacent extensions, and the float portion includes a locking tab configured to fit within a groove to prevent movement between the frame portion and the float portion. In one embodiment of the invention the float portion including at least one lower opening. In another embodiment of the invention, adjusting the float portion relative to the frame portion adjusts flush volume of liquid in the toilet tank. In yet another embodiment of the invention the frame portion includes reference indicators corresponding to different flush volumes. In still another embodiment of the invention the at least one opening formed between the frame portion and the float portion adjusts from a closed setting to a fully open setting. In one embodiment of the invention the buoyancy of the flapper is adjusted during assembly to a standard flush rate and remains non-adjustable thereafter.

Still another aspect of the invention provides a method of variably adjusting flush volume of a toilet. The method comprises providing a flapper frame, providing a float, coupling the float to the flapper frame, and rotating the float relative to the flapper frame to adjust flush volume in the toilet. In one embodiment of the invention, rotating the float adjusts an opening formed between the flapper frame and the float from a closed position to an adjustable open position. In yet another embodiment of the invention, rotating adjusts buoyancy of the float in a liquid. In still another embodiment of the invention, the method further comprises removing a non-adjustable flapper from a toilet, and replacing the non-adjustable flapper with an adjustable flapper formed from the flapper frame and the float. In one embodiment of the invention the adjustable flapper is adjustable to place the toilet in compliance with different standard flush volumes. In another embodiment of the invention the float is rotated relative to the flapper frame to adjust flush volume during assembly to a standard flush volume and remains non-adjustable thereafter.

Other aspects and advantages of the present invention will become apparent from the following detailed description, which, when taken in conjunction with the drawings, illustrate by way of example the principles of the invention.

The invention, now having been briefly summarized, may be better appreciated by the following detailed description.

BRIEF DESCRIPTION OF THE DRAWINGS

For a fuller understanding of the nature and advantages of the invention, as well as a preferred mode of use, reference should be made to the following detailed description read in conjunction with the accompanying drawings, in which.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
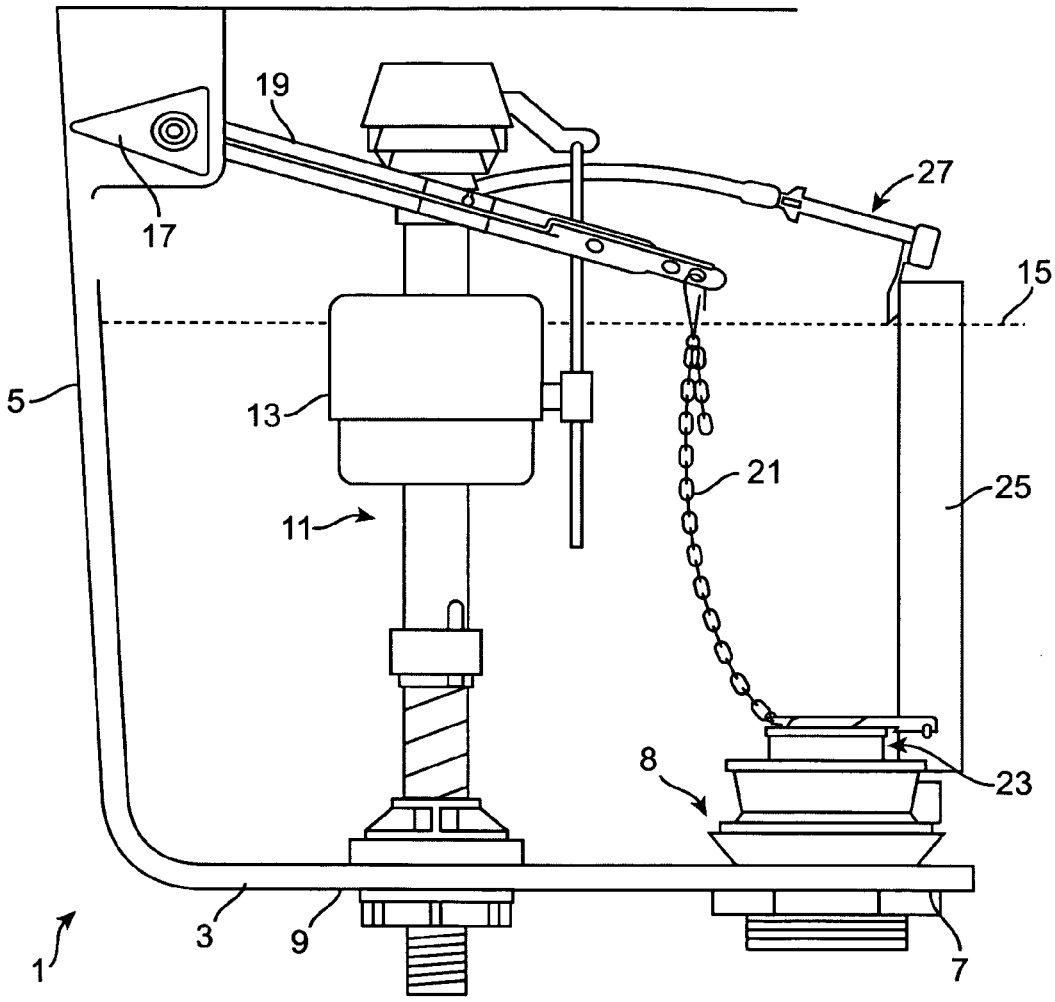
FIG. 1 is a partially-cut side view of a toilet tank employing a variable buoyancy setting flapper in accordance with an embodiment of the invention.

As illustrated in FIG. 1, a toilet tank 1 has a bottom 3 and a peripheral sidewall 5. A water discharge aperture 7 and an inlet aperture 9 are formed in the bottom 3 of the tank 1. The discharge aperture 7 is fitted with a flush valve 8 for discharging water from a tank to flush a toilet bowl (not shown), while the inlet aperture 9 is fitted with a fill valve 11 for supplying water for filling the tank 1.

The fill valve 11 is connected to a water supply line (not shown) at the inlet aperture 9, and is secured to the bottom 3 of the tank 1. A float 13 is wrapped around the valve body of the fill valve 11. Water under pressure in the tap through the inlet aperture 9 is conveyed through an inner cylinder of the fill valve 11 upwards. The float 13 follows the water or fluid level 15 to actuate the fill valve 11. The fill valve 11 remains open when the water or fluid level 15 in the tank 1 is below a predetermined elevation, and supplies water to the tank 1.

When a flush handle 17 is pressed, a lever 19 lifts a flapper 23 of the flush valve 8 through a chain 21, allowing the fluid in the tank 1 to flow into the toilet bowl through the flush valve 8. The flush valve 8 remains open until the buoyancy force on the flapper 23 is no longer sufficient for the flapper 23 to remain in its lifted state. As the flapper 23 drops, the fill valve 8 is sealed.

The toilet may also have a refill water system that supplies adequate amount of refill water to the toilet bowl while the fill valve restores water in the tank after flush. Siphonic toilets will not properly function if residual water inside the bowl is not restored properly per the manufacturer's specification. This is achieved, for example, using an overflow tube 25 fluidly connected to the toilet bowl, and the overflow tube 25 receives some water or fluid from a refill tube 27.

In the embodiment shown in FIG. 1, the flapper 23 of the flush valve apparatus 8 is a variable buoyancy setting flapper, and is of particular interest to the invention. Both the flapper 23 for the flush valve 8 and the float 13 for the fill valve 11 effect the amount of water consumption per flush. As discussed earlier, the float 13 for the fill valve 11 determines the predetermined water level 15 in the tank 1. Not all of the water in the tank below the predetermined water level 15 will be consumed for each flush. Rather, once the water level in the tank 1 is below a residual level such that the buoyancy force on the flapper 23 is insufficient to sustain the flush valve 8 in its "open" state, the flush valve 8 is closed by the flapper 23. Thus, the amount of water consumption per flush is the water between the predetermined level 15 and the residual water level. The variable buoyancy setting flapper 23 in accordance with embodiments of the invention can be used to adjust the residual water level.

In a conventional toilet system, a flush valve has a floatation device to control the flapper to stay open for a desired time period to get an adequate amount of flush volume for each use. The buoyancy provided by the floatation device is usually fixed.

As the standardization for the water consumption per flush becomes important due to requirements or a set of standards, embodiments of the invention provide ways of meeting different standards, for example, in different regions/countries, arid locations, water cost considerations, etc.

An adjustable-size air bleeding hole that is capable of reliably controlling a wide range of buoyant forces is included in a variable buoyancy setting flapper according to a preferred embodiment of the invention. Linear buoyant force control is achieved by adding a second hole that is synchronistical sizeable with the first air bleeding hole on the opposite side.

Figure 2:
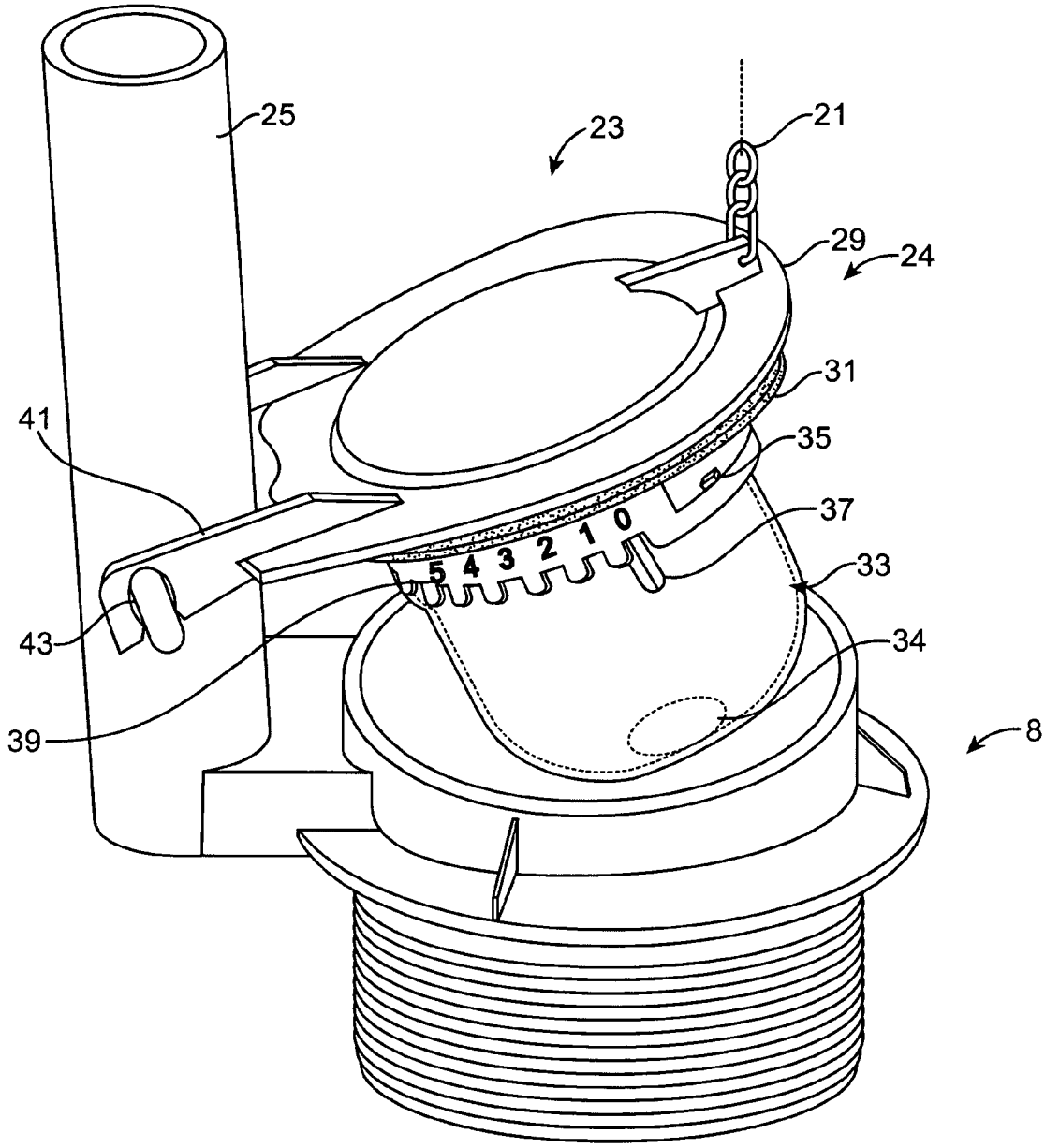
FIG. 2 is a close-up perspective view of the variable buoyancy setting flapper of FIG. 1.

FIG. 2 illustrates a detailed view of a preferred embodiment of the flapper device 23. The flapper device 23 has an upper portion 24 including a flapper frame 29 and a seal 31.

A float 33 is coupled to the upper portion 24. The float 33 has a bottom hole 34 for releasing fluid therethrough. The float 33 is rotationally adjustable relative to the upper portion, and can be locked in relation to the upper portion 24 using a snap tap 35. A rotational locking tab 37 is used to set the relative position between the upper portion 24 and the float 33. The locking tab 37 locks the relative position into one of the predetermined positions labeled with numeral signs 39 such as "0, 1, 2, 3, . . . ," and also serves as a float setting indicator for a user to visualize such positions.

The flapper device 23 is coupled to the overflow tube 25 using, for example, a pair of hooks or mounting legs 41, which allows the flapper device 23 to be rotatable about a pivot point 43 on the overflow tube 25.

Figure 3:
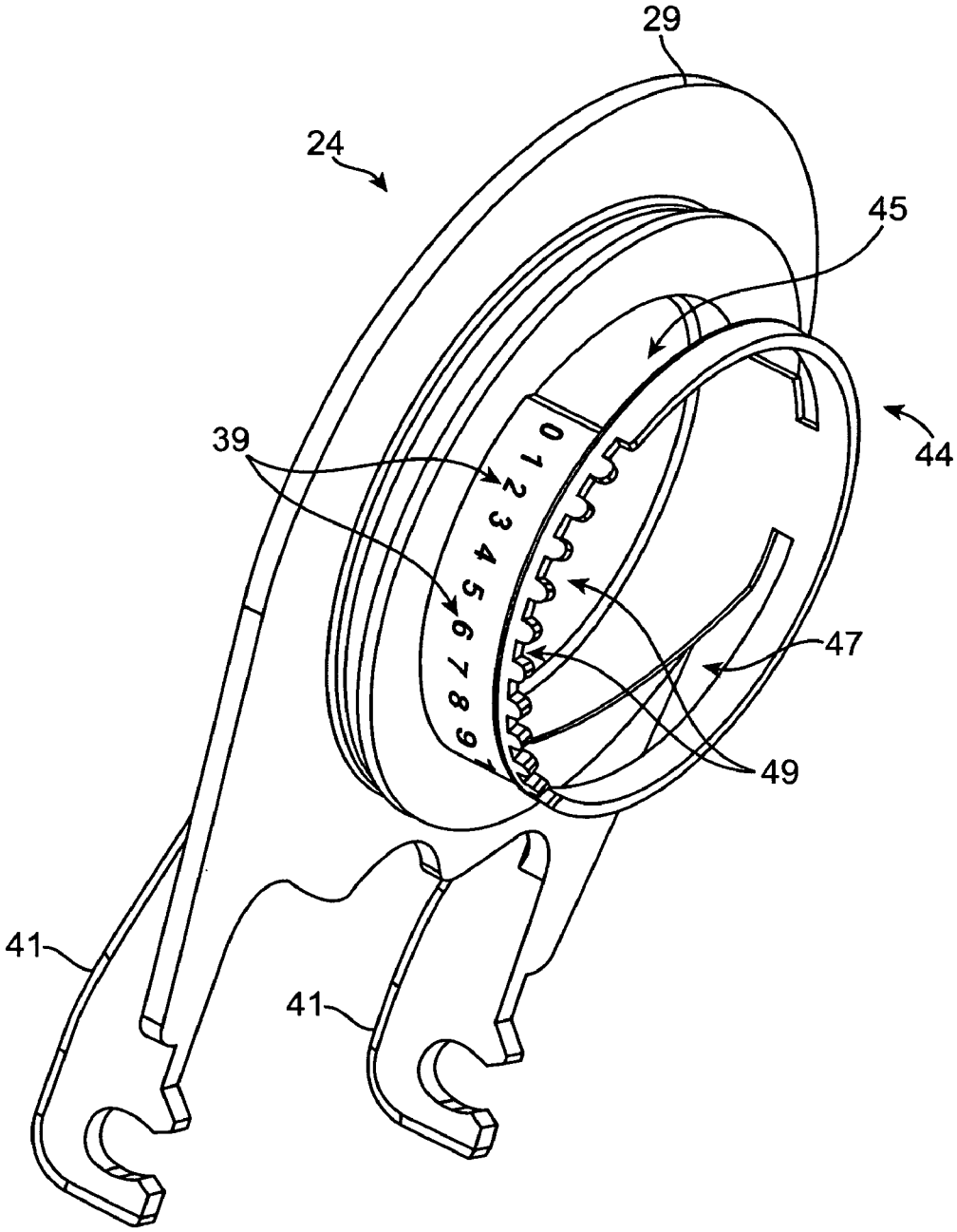
FIG. 3 is a close-up perspective view of an upper portion of the variable buoyancy setting flapper of FIG. 2.

FIG. 3 illustrates a close-up view of the upper portion 24 of the flapper device 23. As illustrated, a cap portion 44, which is shown as a cylinder ring, is integrally formed with the flapper frame 29. The cap portion 44 has a front air relieve hole/slot 45, and a rear air relief hole/slot 47. A plurality of key grooves 49 corresponding to the embossed numeral signs 39 are used to lock onto the rotational locking tab 37 of the float 33.

Figure 4:
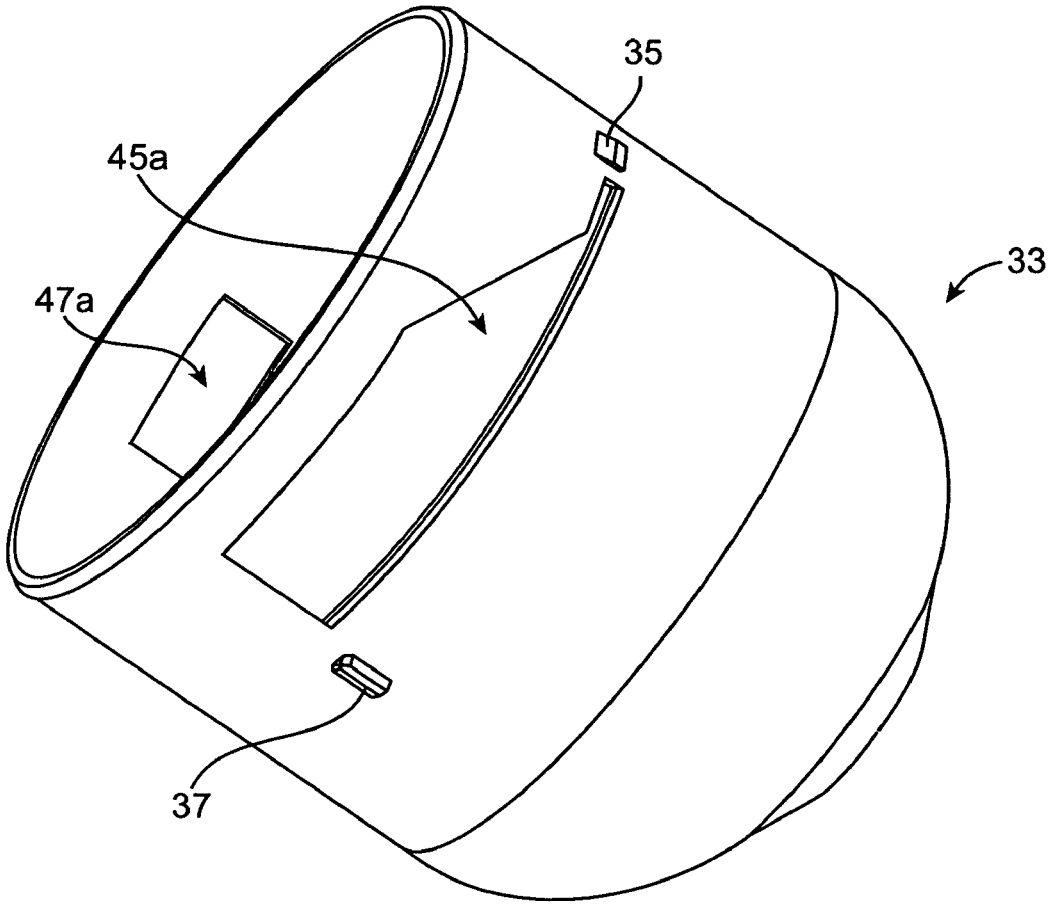
FIG. 4 is a close-up perspective view of a lower float portion of the variable buoyancy setting flapper of FIG. 2.

FIG. 4 illustrates a close-up perspective view of the lower float portion 33, also referred to as a "float cup," of the variable buoyancy setting flapper 23. The float 33 is substantially hollow, and has a front air relief hole/slot **45*a* and a rear air relief hole/slot 47*a* corresponding to the front air relief hole/slot 45 and the rear air relief hole/slot 47 of the flapper frame 29, respectively. The front air relief hole/slot 45*a* and the rear air relief hole/slot 47*a*** as shown are substantially opposing to each other.

Two radial snap tabs 35 (only one is visible) and the rotational locking tab 37 are formed on the outer surface of the float portion 33. The two radial snap tabs 35 of the float portion 33 snap in the rectangular holes of the flapper frame 29. The vertical rotational locking tab 37 of the float portion 33 is engaged in one of the grooves 49 of the flapper frame 29. These two locking features are used to secure the float portion 33 to the flapper frame 29. The radial snap tabs 35 are used to attach the float portion 33 into the flapper frame 29, and the vertical rotational locking tab 37 is used to prevent radial movement of the float portion 33. Two holes, which may be of any shape such as rectangular, formed by the flapper frame 29 and float portion 33, vary in size depending on the engagement position of the vertical rotational locking tab 37 of the float portion 33. For instance, a "10" setting engagement forms maximum openings of both holes for the least amount of buoyant force. A setting of "0" engagement closes both openings for the maximum amount of buoyant force. All other settings progressively form different sized openings from settings "0" to "10," resulting in incremental buoyant force accordingly.

The two openings formed by the flapper frame 29 and the float portion 33 are sized and shaped to achieve a flush volume for each toilet system needed. Accordingly, some tapering in the shapes of the relief holes/slots 45, **45*a*, 47, and 47*a*** may be needed.

Furthermore, this device can be an adjustable flush volume flapper by shortening the vertical locking tab of the float portion 33 to have an adequate amount of engagement between the float portion 33 and the flapper frame 29. This allows the float to rotate with a cricking feeling, yet maintains the setting position during operation.

Figure 5:
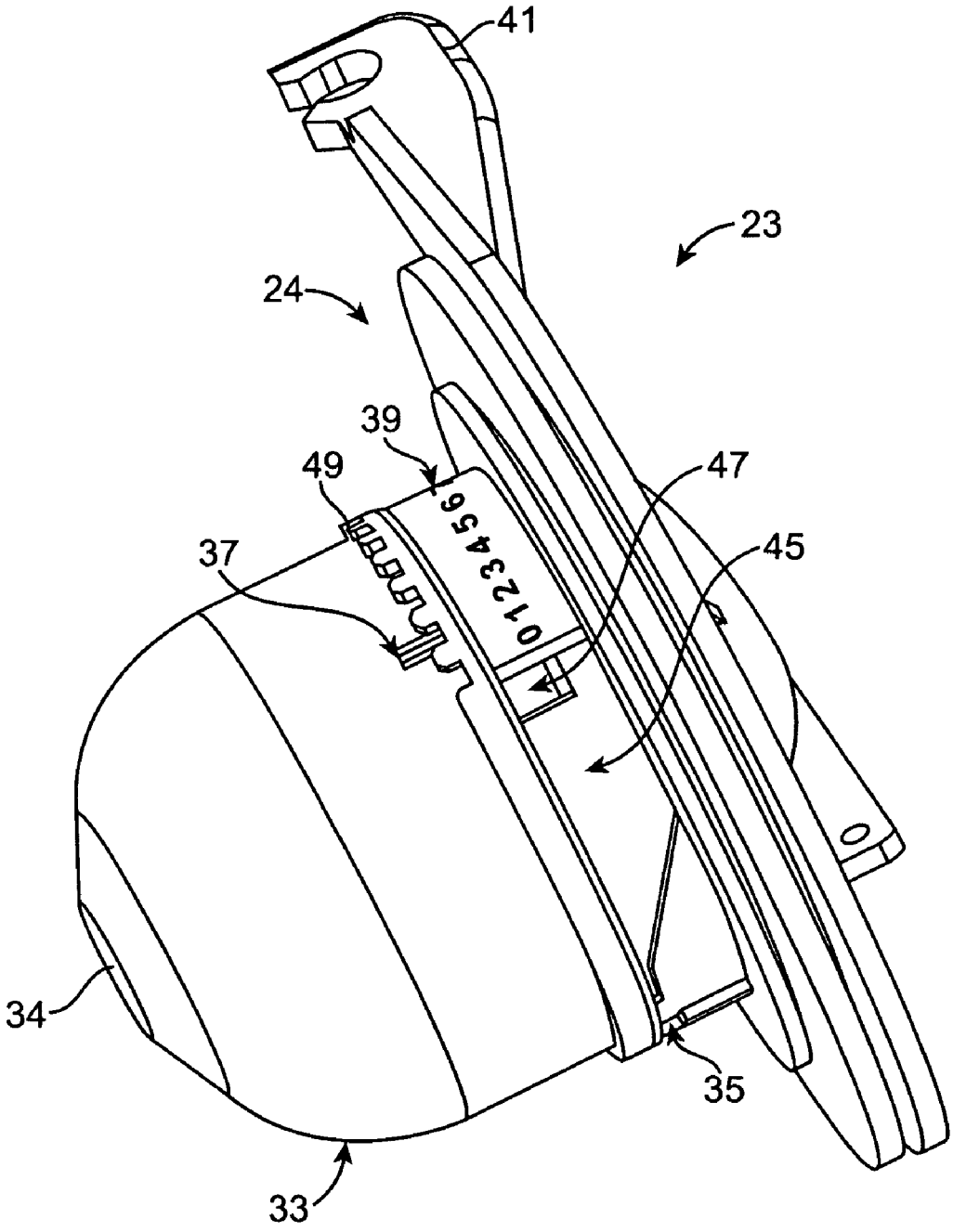
FIG. 5 is a perspective view of the variable buoyancy setting flapper of FIG. 2 in a first adjusted position.

FIG. 5 illustrates a perspective view of the variable buoyancy setting flapper 23 set in a first adjusted position. As illustrated, the front air relief hole/slot 45 on the upper portion 24 is substantially aligned with the corresponding front air relief hole/slot 45*a* on the float portion 33 forming a large opening, and allowing air to bleed quickly therethrough.

Figure 6:
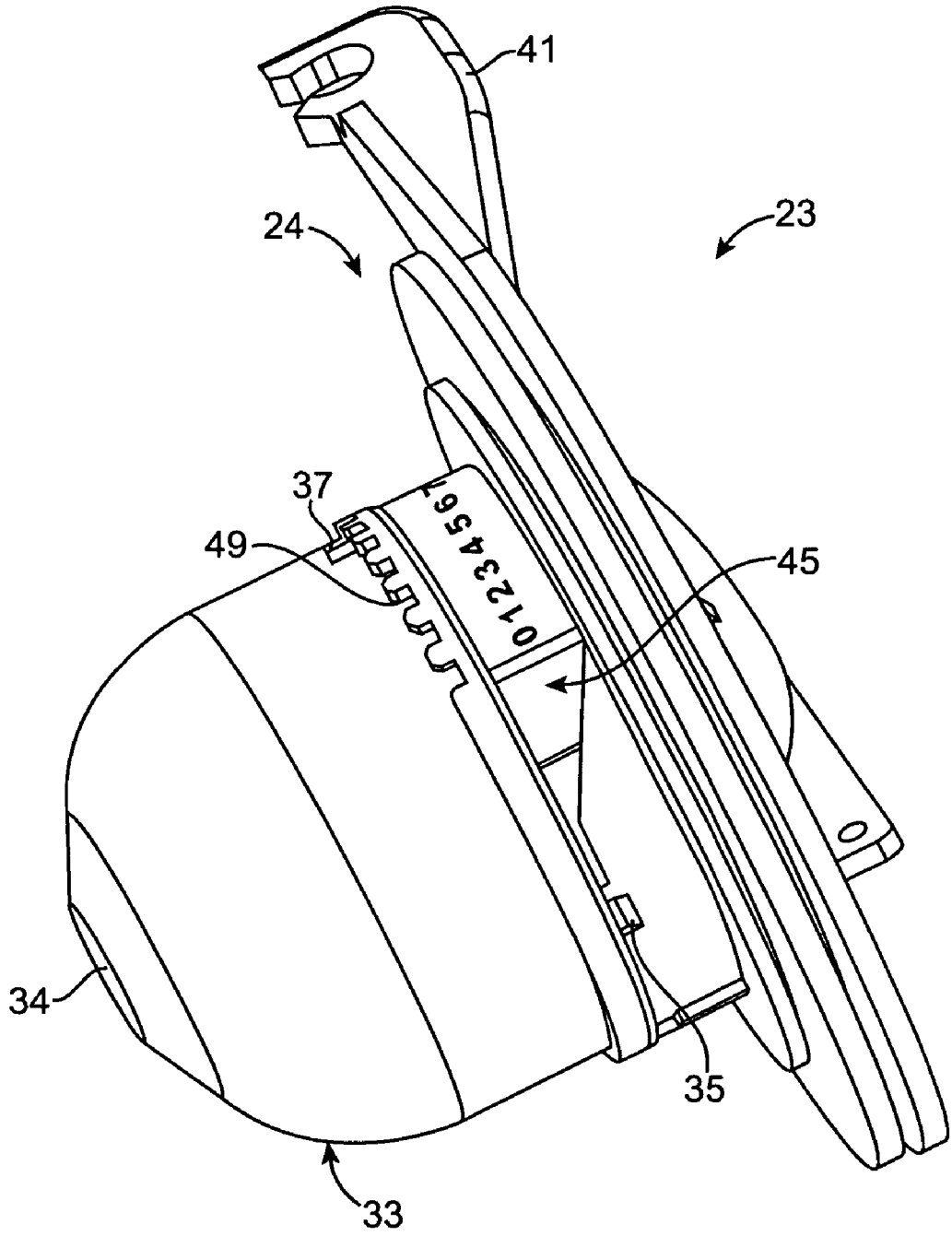
FIG. 6 is a perspective view of the variable buoyancy setting flapper of FIG. 2 in a second adjusted position.

FIG. 6 illustrates a perspective view of the variable buoyancy setting flapper 23 set in a second adjusted position. As illustrated, the opening formed by the front air relief hole/slot 45 on the upper portion 24 and the corresponding front air relief hole/slot 45*a* on the float portion 33 is smaller than of the first position shown in FIG. 5, which retards air from bleeding out therethrough.

Tables 1A-1C show measured data for three different embodiments each at the ten different settings.

Tables 1A-1C show measured data for three different embodiments each at the ten different settings.

TABLE 1A

| Setting | Flush volume (liter) | | | |
|---|---|---|---|---|
| 1 | 3.23 | 3.16 | 3.40 | 3.26 |
| 2 | 3.75 | 3.78 | 4.03 | 3.85 |
| 3 | 3.95 | 4.07 | 4.08 | 4.03 |
| 4 | 4.38 | 4.33 | 4.40 | 4.37 |
| 5 | 4.67 | 4.71 | 4.72 | 4.70 |
| 6 | 4.85 | 4.78 | 4.87 | 4.83 |
| 7 | 4.92 | 4.84 | 4.89 | 4.88 |
| 8 | 5.00 | 5.00 | 5.10 | 5.03 |
| 9 | 5.75 | 5.72 | 5.10 | 5.73 |
| 10 | 5.68 | 5.73 | 5.76 | 5.72 |

TABLE 1B

| Setting | Flush volume (liter) | | | |
|---|---|---|---|---|
| 1 | 3.68 | 3.77 | 3.78 | 3.74 |
| 2 | 3.93 | 3.97 | 3.98 | 3.96 |
| 3 | 4.43 | 4.28 | 4.23 | 4.31 |
| 4 | 4.55 | 4.38 | 4.45 | 4.46 |
| 5 | 4.65 | 4.6 | 4.61 | 4.62 |
| 6 | 4.83 | 4.74 | 4.76 | 4.76 |
| 7 | 4.795 | 4.93 | 4.92 | 4.90 |
| 8 | 4.84 | 5.03 | 5.03 | 4.97 |
| 9 | 5.2 | 5.26 | 5.3 | 5.25 |
| 10 | 5.68 | 5.73 | 5.76 | 5.72 |

TABLE 1C

| Setting | Flush volume (liter) | | | |
|---|---|---|---|---|
| 1 | 3.58 | 3.47 | 3.62 | 3.56 |
| 2 | 3.7 | 3.75 | 3.87 | 3.77 |
| 3 | 4.1 | 4.12 | 4.18 | 4.13 |
| 4 | 4.4 | 4.28 | 4.34 | 4.34 |
| 5 | 4.63 | 4.6 | 4.65 | 4.63 |
| 6 | 4.83 | 4.8 | 4.8 | 4.81 |
| 7 | 4.98 | 4.93 | 4.95 | 4.95 |
| 8 | 5.19 | 5.13 | 5.19 | 5.17 |
| 9 | 5.62 | 5.52 | 5.39 | 5.51 |
| 10 | 5.64 | 5.7 | 5.79 | 5.71 |

Figure 7A:
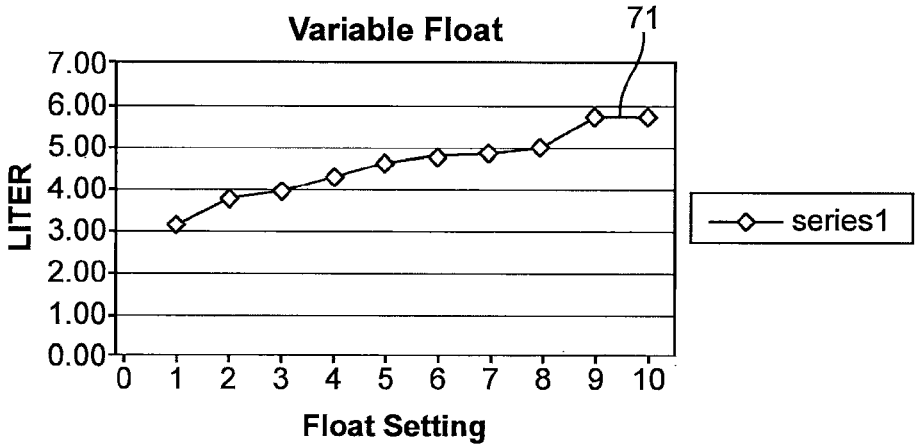
FIGS. 7A-7C illustrate test data for different float settings.
Figure 7B:
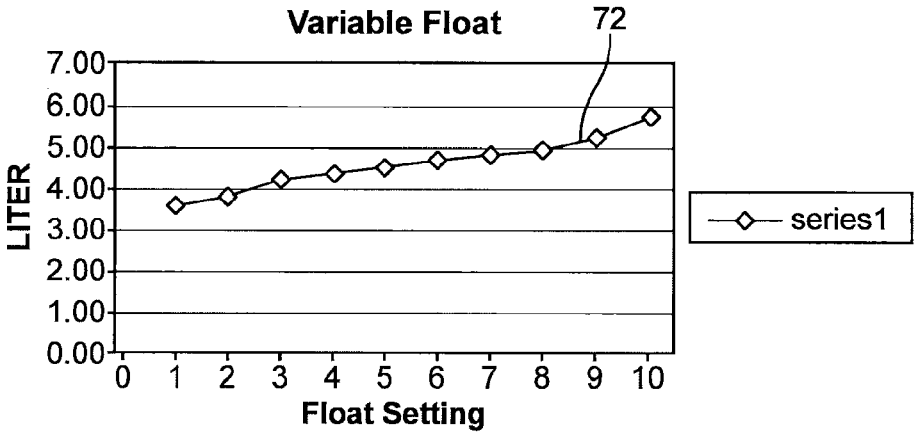
Figure 7C:
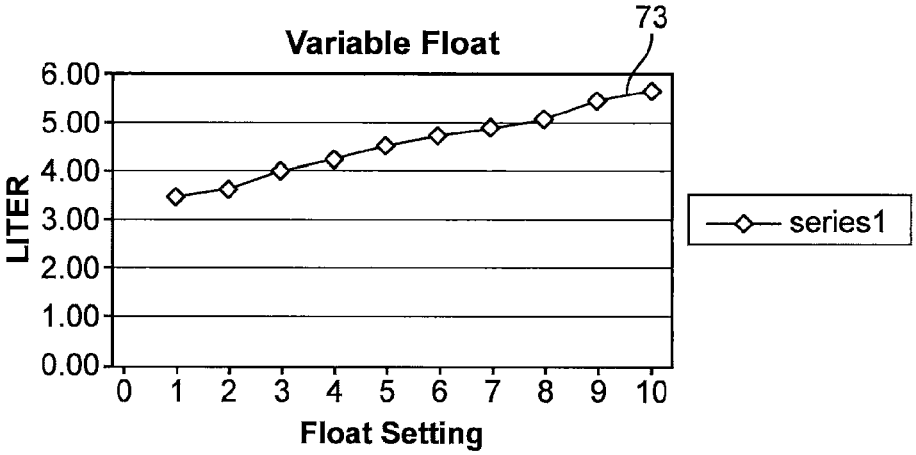

FIGS. 7A-7C illustrate the test data corresponding to Tables 1A-C for different settings in graphical form. It should be noted that in one embodiment of the invention the buoyancy of the flapper is adjusted during assembly to a standard flush rate and remains non-adjustable thereafter.

Figure 8:
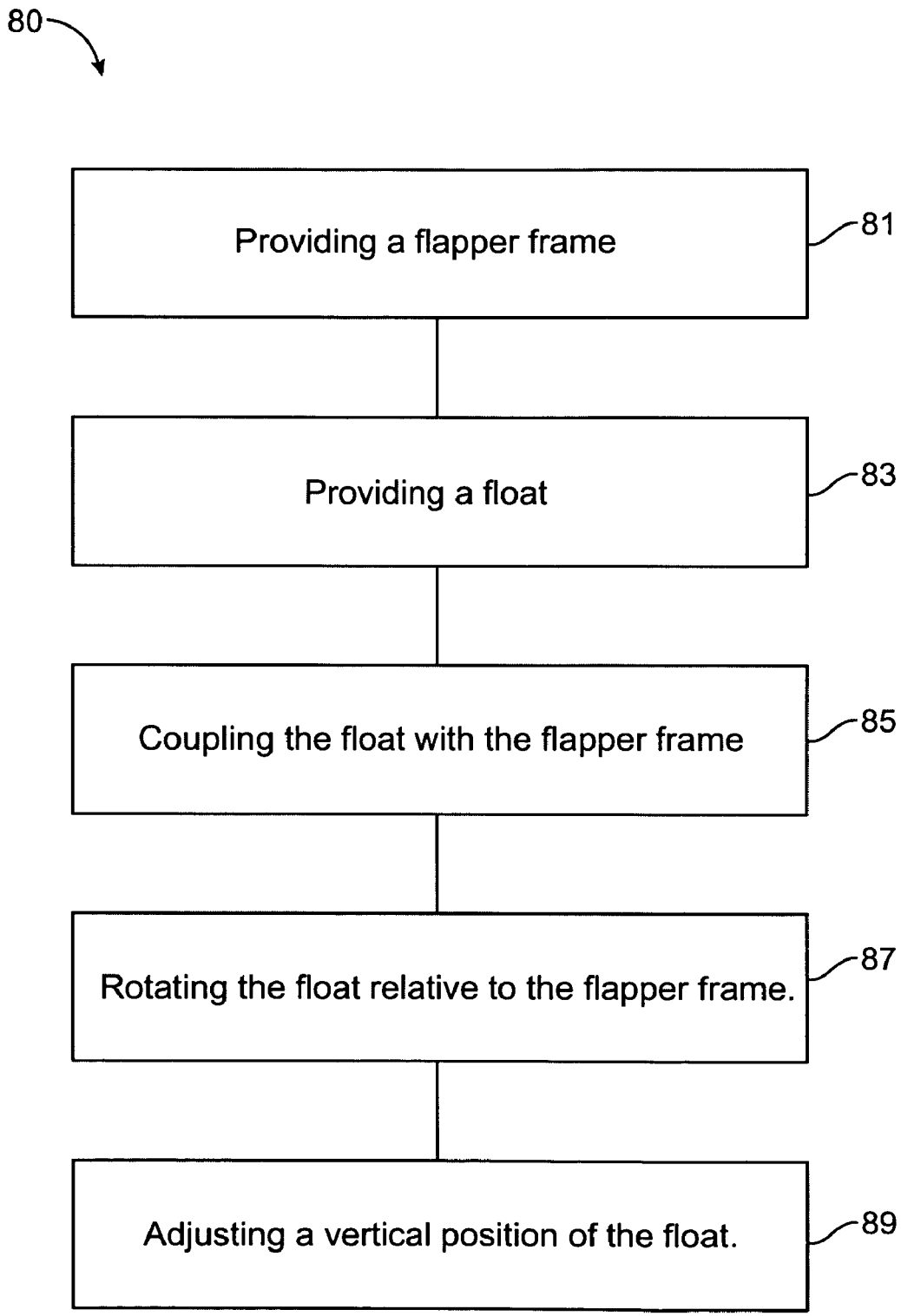
FIG. 8 illustrates a block diagram of a preferred method of installing and operating a variable buoyancy setting flapper according to embodiments of the invention.

FIG. 8 illustrates a block diagram of a method 80 of installing and operating the flush valve according to an embodiment of the invention. In step 81, a flapper frame is provided. In step 83, a float is provided. In step 85, the float is coupled with the flapper frame. In step 87, the float is rotated relative to the flapper frame to adjust flow volume. In step 89, the vertical position of the float is adjusted. Thus, the amount of water consumption per flush can be adjusted according to a specified regional standard, e.g., 1.6 gallon (~6 liters) per flush according to some U.S. standards, or different standards according to, for example, European regulations.

Advantageously, the variable buoyancy setting flapper device according to embodiments of the invention allows an easy adjustment of water consumption per flush for the toilet tank. This helps meeting different water consumption standards in different regions. Further, the embodiments include the openings that are shaped and sized to avoid blockage by contaminants, such as mineral deposits, portions of worn internal tank portions or equipment, external material, etc. Additionally, the elongated size and shape of the openings allow for accurate flow standards to be met and corresponded to by the reference numbers 39.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. A flush valve apparatus for discharging fluid from a tank, comprising:

a flapper including:

a frame portion comprising a cylindrical ring with a front slot and a tapered rear slot; and a hollow float portion rotatably coupled to the frame portion, wherein a top portion of the float is received within the cylindrical ring, and wherein the float has a rear slot and a tapered front air relief slot, wherein a relative rotational position between the frame portion and the float portion causes the front openings and rear openings to interact with one another to vary the size of the openings to control an amount of fluid discharged from the tank by variably adjusting buoyancy of the flapper.

2. The flush valve apparatus of claim 1, wherein the frame portion includes a plurality of extensions forming a plurality of grooves between adjacent extensions, and the float portion includes a tab configured to fit within a groove to prevent movement between the frame portion and the float portion.

3. The flush valve apparatus of claim 1, wherein the float portion including at least one lower hole portion.

4. The flush valve apparatus of claim 1, wherein adjusting the float portion relative to the frame portion adjusts flush volume of the tank to correspond to different flush volume standards.

5. The flush valve of claim 1, wherein the buoyancy of the flapper is adjusted during assembly to a standard flush rate and remains non-adjustable thereafter.

6. The flush valve apparatus of claim 1, wherein the flush valve is configured to a standard size.

7. The flush valve apparatus of claim 1, wherein the frame portion includes reference indicators corresponding to different flush volume rates.

8. A variable buoyancy flapper, comprising:

a frame portion comprising a cylindrical ring with a front slot and a tapered rear slot, the frame portion including a sealing portion; and a float portion rotatably coupled to the frame portion, wherein a top portion of the float is received within the cylindrical ring, and wherein the float has a rear air relief slot and a tapered front air relief slot, wherein rotating the float portion simultaneously causes the front openings and rear openings to interact with one another to vary the size of the openings to control buoyancy of the flapper.

9. The variable buoyancy flapper of claim 8, wherein the frame portion includes at least one corresponding slot portion to the slot portion of the float portion.

10. The variable buoyancy flapper of claim 8, wherein the frame portion includes a plurality of extensions forming a plurality of grooves between adjacent extensions, and the float portion includes a locking tab configured to fit within a groove to prevent movement between the frame portion and the float portion.

11. The variable buoyancy flapper of claim 8, wherein the float portion including at least one lower opening.

12. The variable buoyancy flapper of claim 8, wherein the variable buoyancy flapper is configured as a valve in a toilet tank, and adjusting the float portion relative to the frame portion adjusts flow volume of liquid in the toilet tank.

13. The variable buoyancy flapper of claim 8, wherein the frame portion includes reference indicators corresponding to different flush volumes.

14. The variable buoyancy flapper of claim 8, wherein the at least one opening formed between the frame portion and the float portion adjusts from a closed setting to a fully open setting.

15. The variable buoyancy flapper of claim 8, wherein the buoyancy of the flapper is adjusted during assembly to a standard flush rate and remains non-adjustable thereafter.

16. A method of variably adjusting flush volume of a toilet, the method comprising:

providing a flapper frame comprising a cylindrical ring with a front slot and a tapered rear slot;

providing a float, wherein a top portion of the float is received within the cylindrical ring, and wherein the float has a rear air relief slot and a tapered front air relief slot;

coupling the float to the flapper frame; and rotating the float relative to the flapper frame to simultaneously cause the front openings and rear openings to interact with one another to vary the size of the openings to adjust flush volume in the toilet.

17. The method of claim 16, wherein said rotating the float adjusts an opening formed between the flapper frame and the float from a closed position to an adjustable open position.

18. The method of claim 16, wherein said rotating adjusts buoyancy of the float in a liquid.

19. The method of claim 16, further comprising:

removing a non-adjustable flapper from a toilet; and replacing the non-adjustable flapper with an adjustable flapper formed from the flapper frame and the float.

20. The method of claim 19, wherein the adjustable flapper is adjustable to place the toilet in compliance with different standard flush volumes.

21. The method of claim 19, wherein the float is rotated relative to the flapper frame to adjust flush volume during assembly to a standard flush volume and remains non-adjustable thereafter.

* * * * *